United States Patent [19]

Banks, Jr.

[11] 4,349,172

[45] Sep. 14, 1982

[54] PLANT POT SUSPENSION APPARATUS AND THE LIKE

[76] Inventor: John J. Banks, Jr., 501 W. Roxbury Pky., West Roxbury, Mass. 02132

[21] Appl. No.: 144,378

[22] Filed: Apr. 28, 1980

[51] Int. Cl.[3] ..... A47G 7/04

[52] U.S. Cl. ..... 248/318; 47/67; 248/322

[58] Field of Search ..... 47/67; 108/149; 248/318, 322, 328; D6/113

[56] References Cited

U.S. PATENT DOCUMENTS

| | | | |
|---|---|---|---|
| D. 77,225 | 12/1928 | Danz | D6/113 |
| 107,073 | 9/1870 | McClunie | 47/67 |
| D. 232,283 | 8/1974 | Wagschal | D6/113 |
| D. 235,601 | 7/1975 | Lewis | D6/113 |
| 4,159,094 | 6/1979 | Stekoll et al. | 248/318 |
| 4,170,089 | 10/1979 | Smrt | D6/113 X |
| 4,227,343 | 10/1980 | Espy et al. | 248/318 X |

FOREIGN PATENT DOCUMENTS

| | | | |
|---|---|---|---|
| 195717 | 4/1923 | United Kingdom | 108/149 |

*Primary Examiner*—Wm. Carter Reynolds
*Attorney, Agent, or Firm*—Rines and Rines, Shapiro and Shepiro

[57] ABSTRACT

This disclosure is concerned with a pot-suspension disc insertable under a plant pot or the like and provided with notches for receiving pot suspension strands passed under the pot and slots between the notches for suspending strands of a further pot to be hung below the first-named pot, enabling the ready suspension of pluralities of plant pots in the same vertical column and preferably from a common suspension point. This disc may also be integrated with any of the pot, a saucer therefor or the suspension strand structure.

14 Claims, 4 Drawing Figures

PLANT POT SUSPENSION APPARATUS AND THE LIKE

The present invention relates to plant pot suspension apparatus and the like, being more particularly concerned with the readily attachable and detachable suspension of pluralities of plant pots and the like in the same vertical column.

Hanging plants provided with suspension strands (such as ropes, ribbons, wires, etc.) secured to the top or sides of the plant pots and/or passed under the bottom of the pots, have been in use for centuries. Of recent years, rope and wire suspensions from ceiling or wall hooks have, indeed, become quite fashionable. Such designs, however, have had the serious drawback that, to provide a substantially vertical column of a plurality of plant pots one under the other, resort has heretofore been had to be made to the rather unsightly and obvious hooking of a lower plant pot suspension to, for example, the strands passed under an upper pot, which technique also introduces undesirable rotational and other instability; or resort to the less than desirable concept of installing a plurality of separate wall hook suspension points, one below the other; or resort to a common ceiling or wall hook with attendant bunching of suspensions and instability.

It is to the solution of this and related problems, accordingly, that the present invention is principally directed, it being an object of the invention to provide a new and improved plant pot or similar suspension apparatus that readily enables the multiple suspension of any number of desired plant pots and the like, one depending from the other in a common vertical column, and that is not subject to the above-described or other disadvantages, and that is readily attachable and detachable, facilely to vary the number of in-line vertically suspended plant pots and the like.

A further object is to provide a novel pot-suspension apparatus of more general applicability, also; other and further objects being more particularly delineated hereinafter and in the appended claims.

In summary, however, from one of its important aspects the invention provides for use in suspending plant pots and the like provided with a plurality of suspension strands spaced circumferentially about the pots and adapted to be secured thereto by a plurality of attachment techniques, including attachment by carrying the strands from a common apex down over the sides of the pots and passing the same under the pots, and attachment of the strands to the upper edge regions of the pots with a common apex hook; a pot-suspension disc having, in combination, a plurality of peripherally spaced guide means that, when the first-named strand attachment technique is employed, where strand portions are passed under the bottom of the pot, are adapted for receiving and holding the strands in peripherally spaced positions when the disc is inserted between the bottom of the pot and the strand portions passed thereunder; the disc being further provided with a plurality of pairs of radial slots peripherally disposed between successive guide means and defining tongues over which may be looped the top portions of the suspension strands of a further pot to be hung directly vertically below and from the disc; and aperture means within the disc that, when the before-named apex hook type of suspension is employed, is adapted to receive such hook to suspend the pot carried thereby from and directly vertically below said inserted disc. Best mode and preferred constructions are hereinafter set forth.

The invention will now be described with reference to the accompanying drawing,

FIG. 1 of which is a top elevation of a preferred suspension disc of the invention;

Figure 1:
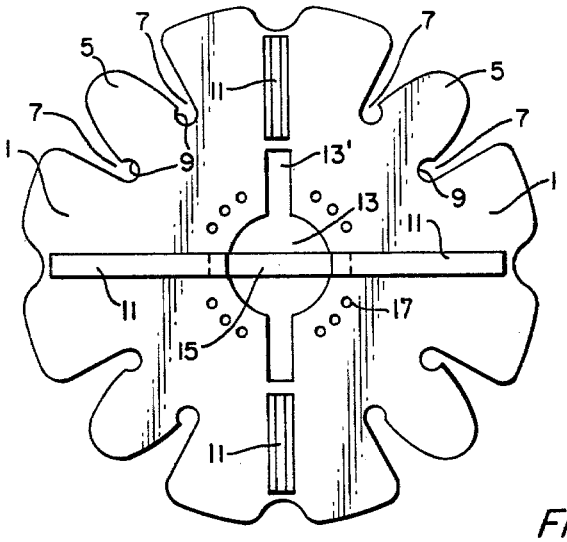
Figure 2:
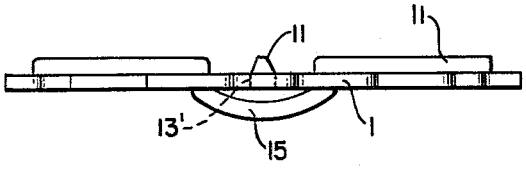
FIG. 2 is a side elevation of the same.
Figure 3:
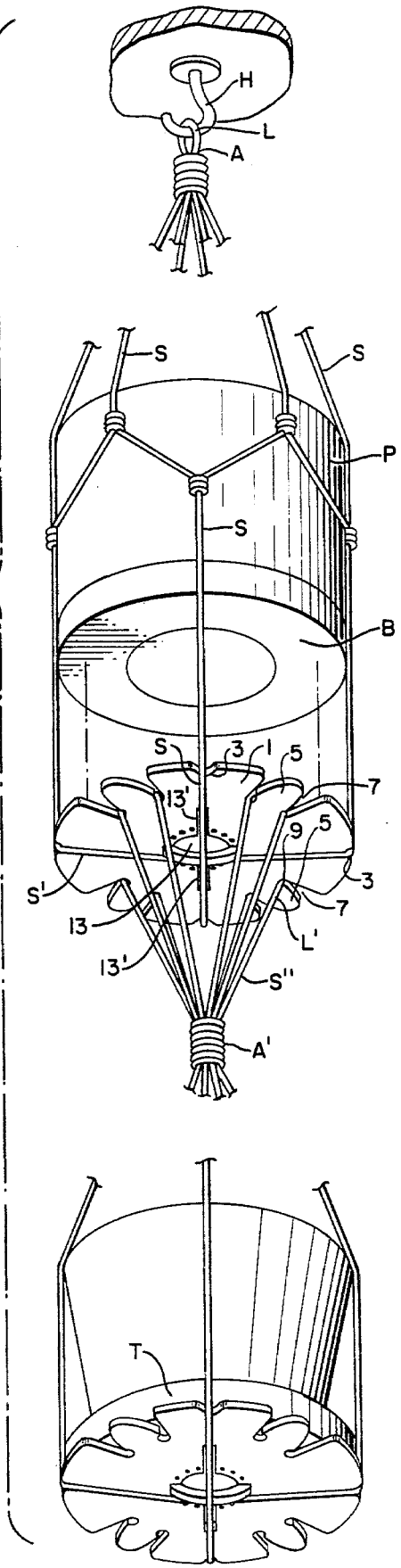
FIG. 3 is an isometric, with parts shown separated to illustrate the installation and operation of the invention.

Referring to FIGS. 1 and 2, the disc 1 of the invention is shown of generally circular contour and of cross-dimension or diameter correspondingly roughly to that of the bottom B of the plant or other pot P (FIG. 3) that it is to serve. In this example, the strand suspension structure for the pot P of FIG. 3 is of the multi-rope variety having strands S that depend from a common suspension apex A that, in turn, is suspended at the upper loop L from, for example, a ceiling hook H, downly over the sides of the pots and passing under the bottom B of the same at S′ to provide a pot-holding frame.

On the upper surface of the disc 1 are preferably provided spacers 11, illustrated in the form of quadrant ridges upon which the bottom B of the pot P is received when the disc 1 is inserted between the pot bottom B and the bottom-crossing strand portions S′. The purpose of these ridges is to provide adequate space and easy accessability in accomodating strands of an additional pot or the like by allowing strands to be easily inserted over hereinafter described fingers or tongues of the disc. The disc is also provided with guide means in the form of a plurality of peripherally spaced guides 3, illustrated in the simple form of U-shaped notches or spacer regions, preferably substantially equi-angularly disposed about the periphery of the disc, for receiving and holding the strands in peripherally spaced fixed positions, though other securing devices could also be employed; and between successive guides 3, there are provided hanging members shown in the form of fingers or tongues 5 forming somewhat radial pairs of slots 7 defining the same and having interior strand locking recesses 9, as later explained. Tongues 5 are preferably also substantially equi-angularly disposed about the periphery of the disc.

When it is desired to hang a similar strand suspension S″ for a further pot or the like in a direct vertical column under the upper pot P, the loops L′ of the top portions of the further suspension S″ are looped over the tongues 5 into the radial slots 7 and are secured in the internal notches 9 to enable a secure, non-twisting lower pot suspension which, in turn, may be provided with a similar disc 1 to enable an additional vertically in-line lower pot suspension (not shown), and so on, as desired. As before stated, the use of the spacer ridges 11 provides a space between the bottom B or the pot P and the upper surface of the disc readily permitting such looped attachment of the next-lower pot suspension S″.

Figure 4:
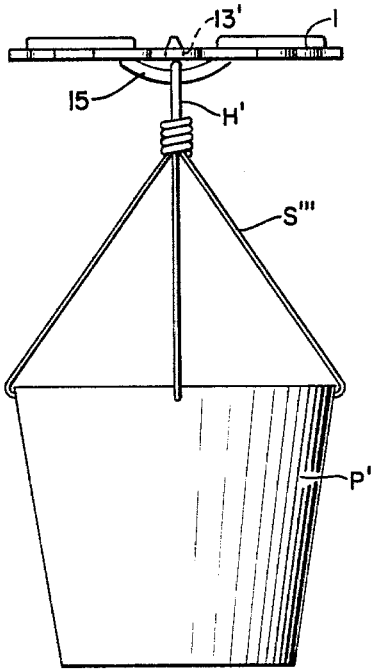
FIG. 4 is a side elevation illustrating modified use.

In the event, however, that is is desired to provide also the facility for suspending from the pot P a lower pot P′ that has a strand suspension of the type shown in FIG. 4, having an apex hook H′ attached as by wire strands S‴ to the upper edge, for example, of the lower pot P′, a central aperture 13 may be provided in the disc with a depending bar 15 extending below the same and key slots 13′ that permit the hooking of the hook H′ thereover and in steady vertical alignment with the upper pot suspension S. The slots 13' and the before-mentioned space between the upper surface of the disc 1 and the pot bottom B provided by the resting spaces 11 enable this hooking operation. A supplementary ring of a plurality of smaller apertures 17 may be provided about the central aperture 13 for hooked or wired depending attachments, also.

While the invention is useful with existing pots and the like, the disc structure may be in the form of a base made integrally part of or otherwise incorporated with the pot bottom B itself or a bottom saucer T therefor, as more particularly shown in the lower pot structure of FIG. 3; and it may also be connected as part of the strand suspension structure.

Though the almost snow-flake-like geometry of the illustrated disc and the arrow-like tongue hanger structure, have been found to be most satisfactory in practice, and enable the ready fabrication of inexpensive discs as of plastic, for example, clearly other geometries and configurations may be employed, as may separate hanging or hooking elements incorporated into the structure or suspension; and other modifications will also suggest themselves to those skilled in the art—such being considered to fall within the spirit and scope of the invention as defined in the appended claims.

What is claimed is:

1. A device for use in suspending plant pots and the like provided with a plurality of suspension strands spaced circumferentially about the pots and adapted to be secured thereto by one of a plurality of attachment techniques, including attachment by carrying the strands from a common apex down over the sides of the pots and passing the same under the pots, and attachment of the strands to the upper edge regions of the pots with a common apex hook; the device comprising a pot-suspension disc having, in combination, a plurality of peripherally spaced guide means that, when the first-named strand attachment technique is employed, wherein the strand portions are passed under the bottom of the pot, are adapted for receiving and holding the strands in peripherally spaced positions when the disc is inserted between the bottom of the pot and the strand portions passed thereunder; the disc being further provided with a plurality of pairs of radial slots peripherally disposed between successive guide means and defining tongues over which may be looped the top portions of the suspension strands of a further pot to be hung directly vertically below and from the disc; and aperture means within the disc that, when the before-named apex hook type of suspension is employed, is adapted to receive such hook to suspend the pot carried thereby from and directly vertically below said inserted disc.

2. A pot-suspension disc as claimed in claim 1 wherein said guide means and tongues are substantially equi-angularly disposed about the periphery of the disc.

3. A pot-suspension disc as claimed in claim 1 and in which spacer means is provided on the upper surface of the disc to provide the resting surface for the bottom of the pot with space between said upper surface and the bottom of the pot.

4. A pot-suspension disc as claimed in claim 1 and in which said guide means comprise notches.

5. A pot-suspension disc as claimed in claim 1 and in which said radial slots and the tongues defined therebetween are shaped to provide locking recesses therein for the strand portions looped thereover.

6. A pot-suspension disc as claimed in claim 1 and in which said aperture means is provided with means for receiving an apex strand hook.

7. A pot-suspension disc as claimed in claim 6 and in which the said hook receiving means comprises a bar depending across a central aperture.

8. A pot-suspension disc as claimed in claim 6 and in which the said hook receiving means comprises a plurality of apertures disposed about the central regions of the disc.

9. A device for use in suspending plant pots and the like provided with a plurality of suspension strands spaced circumferentially about the pots and adapted to be secured thereto by carrying the strands from a common apex down over the sides of the pots and passing the same under the pots; the device comprising a pot-suspension disc having, in combination, a plurality of peripherally spaced guide means that are adapted for receiving and holding the strands in peripherally spaced positions when the disc is inserted between the bottom of the pot and the strand portions passed thereunder; the disc being further provided with a plurality of pairs of radial slots peripherally disposed between successive guide means and defining tongues over which may be looped the top portions of the suspension strands of a further pot to be hung directly vertically below and from the disc.

10. A pot-suspension disc as claimed in claim 9 wherein said guide means and tongues are substantially equi-angularly disposed about the periphery of the disc.

11. A pot-suspension disc as claimed in claim 9 and in which spacer means is provided on the upper surface of the disc to provide the resting surface for the bottom of the pot with space between said upper surface and the bottom of the pot.

12. A pot suspension disc as claimed in claim 9 and in which said guide means comprise notches.

13. A pot-suspension disc as claimed in claim 9 and in which said radial slots and the tongues defined therebetween are shaped to provide locking recesses therein for the strand portions looped thereover.

14. A device for use in suspending plant pots and the like provided with a plurality of suspension strands spaced circumferentially about the pots and adapted to be secured thereto by carrying the strands from a common apex down over the sides of the pots; the device comprising a base incorporated with a pot bottom, or a saucer therefor, and the strand suspension, the base being in the form of a pot-suspension disc having, in combination, a plurality of peripherally spaced guide means that are adapted for receiving and holding the strands in peripherally spaced positions; the disc being further provided with a plurality of pairs of radial slots peripherally disposed between successive guide means and defining tongues over which may be looped the top portions of the suspension strands of a further pot to be hung directly vertically below and from the disc.

* * * * *